US008021068B2

(12) United States Patent
Shih

(10) Patent No.: US 8,021,068 B2
(45) Date of Patent: Sep. 20, 2011

(54) COSMETICS CONTAINER STRUCTURE

(75) Inventor: Ko-Chen Shih, Taoyuan (TW)

(73) Assignee: Jia Hsing Enterprise Co., Ltd., Changhua Hsien (TW)

( * ) Notice: Subject to any disclaimer, the term of this patent is extended or adjusted under 35 U.S.C. 154(b) by 489 days.

(21) Appl. No.: 12/330,973

(22) Filed: Dec. 9, 2008

(65) Prior Publication Data

US 2010/0143022 A1 Jun. 10, 2010

(51) Int. Cl.
*A47K 11/04* (2006.01)

(52) U.S. Cl. ..... 401/277

(58) Field of Classification Search ..... 401/171–174, 401/268, 277–279, 286
See application file for complete search history.

(56) References Cited

U.S. PATENT DOCUMENTS 6,688,796 B1 * 2/2004 Liu ..... 401/277
6,702,158 B2 * 3/2004 Kageyama et al. ..... 222/386

* cited by examiner

*Primary Examiner* — Huyen Le
(74) *Attorney, Agent, or Firm* — Senniger Powers LLP

(57) ABSTRACT

A cosmetics container structure comprises an outer tube having an actuating chamber and a receiving chamber. A control assembly includes a coupling cylinder having a button opening at the center and multiple obliquely-cut pieces with sliding surfaces alternating with clearance grooves at the internal surface thereon. A button post has a first toothed-collar defining the opening edge with protrusive blocks disposed above. An actuation assembly includes a rotary tube, a spring element, and an insert seat. The rotary tube has a second toothed-collar equipped with high and low stop surfaces, and a conjoining cavity at the bottom. The insert seat has a screw-threaded bore disposed at the bottom. A push rod has a rod body defined by an external-threaded section and identically shaped like the conjoining cavity thereof. Thus, the button post can be simply pressed by single hand to squeeze out filling substance for easy and economical application thereby.

10 Claims, 8 Drawing Sheets

COSMETICS CONTAINER STRUCTURE

BACKGROUND OF THE INVENTION

The present invention relates to a cosmetics container structure wherein an outer tube is composed of a receiving chamber to accommodate filling substance therein, and an actuating chamber to which a control assembly and an actuation assembly are respectively mounted thereto; whereby a button post mounted to a coupling cylinder of the control assembly can be simply pressed by single hand to activate a rotary tube of the actuation assembly and descend a push rod therewith, permitting equal and appropriate portion of the filling substance to be released for easy and economical application thereby.

Conventionally, cosmetics containers are characterized by the design of rotary operation wherein a cosmetics container is rotated so as to squeeze out cosmetic substance via a covering sheath. In application, the cosmetics container must be held by both hands so as to rotate a rod body or a top portion of the container for the release of the cosmetic substance. As a result, it's impossible to put on cosmetics by single hand when the user is busy with some other things at the same time. In addition, due to the rotating-and-squeezing manner, the cosmetic substance can be irregularly dispensed in application. In case the container is rotated by great force or spun too many coils, the cosmetic substance can be instantly emitted outwards in a large quantity and cause a waste of it. In contrast, too little cosmetic substance can be released due to insufficient rotation of the container. Thus, the conventional cosmetic container is quite inconvenient in application.

SUMMARY OF THE PRESENT INVENTION

It is, therefore, the primary purpose of the present invention to provide a cosmetics container structure wherein a coupling cylinder is positioned via clearance grooves into which protrusive blocks of a button post are embedded respectively, and a rotary tube is equipped with a second toothed-collar whose toothed sections are positioned to abut against sliding surfaces extending inside the coupling cylinder, permitting a first toothed-collar of the button post to keep an appropriate length of space from the second toothed-collar thereof; whereby, when affected by force exerting thereon, the first toothed-collar will slide from high stop surfaces of the second toothed-collar to low stop surfaces thereof to mesh with the second toothed-collar thereby permitting the second toothed-collar to rotate towards one side therewith; thus, the button post is simply pressed to activate the rotation of an actuation assembly and descend therewith a push rod pressing against a stop plug to squeeze out filling substance for use via the pressing operation of single hand, achieving easy wearing of cosmetics thereby.

It is, therefore, the second purpose of the present invention to provide a cosmetics container structure wherein the first toothed-collar of the button post is utilized to match to the high and low stop surfaces of the second toothed-collar thereof; whereby the button post is pressed to slide the first toothed-collar thereof from the high to the low stop surfaces of the second toothed-collar for an appropriate distance that also specifies as the range for the rotation of the push rod to squeeze out the filling substance for use; thus, the filling substance can be evenly dispensed in equal portion each time and the user can accurately determine the amount of the filling substance required via the number of pressing operation, achieving easy and economical application thereby.

DETAILED DESCRIPTION OF THE PREFERRED EMBODIMENTS

Figure 1:
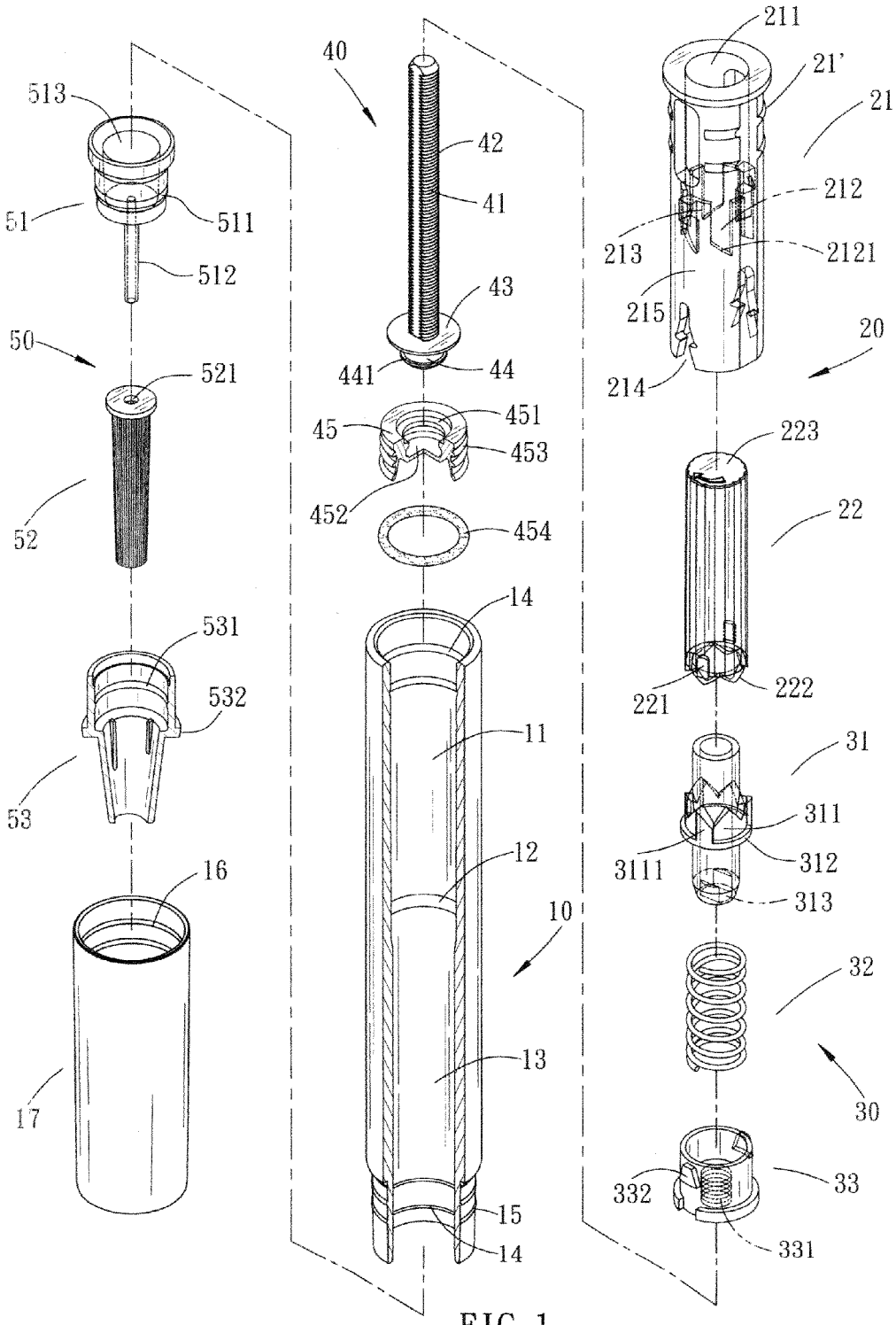
FIG. 1 is an exploded perspective view of the present invention.
Figure 2:
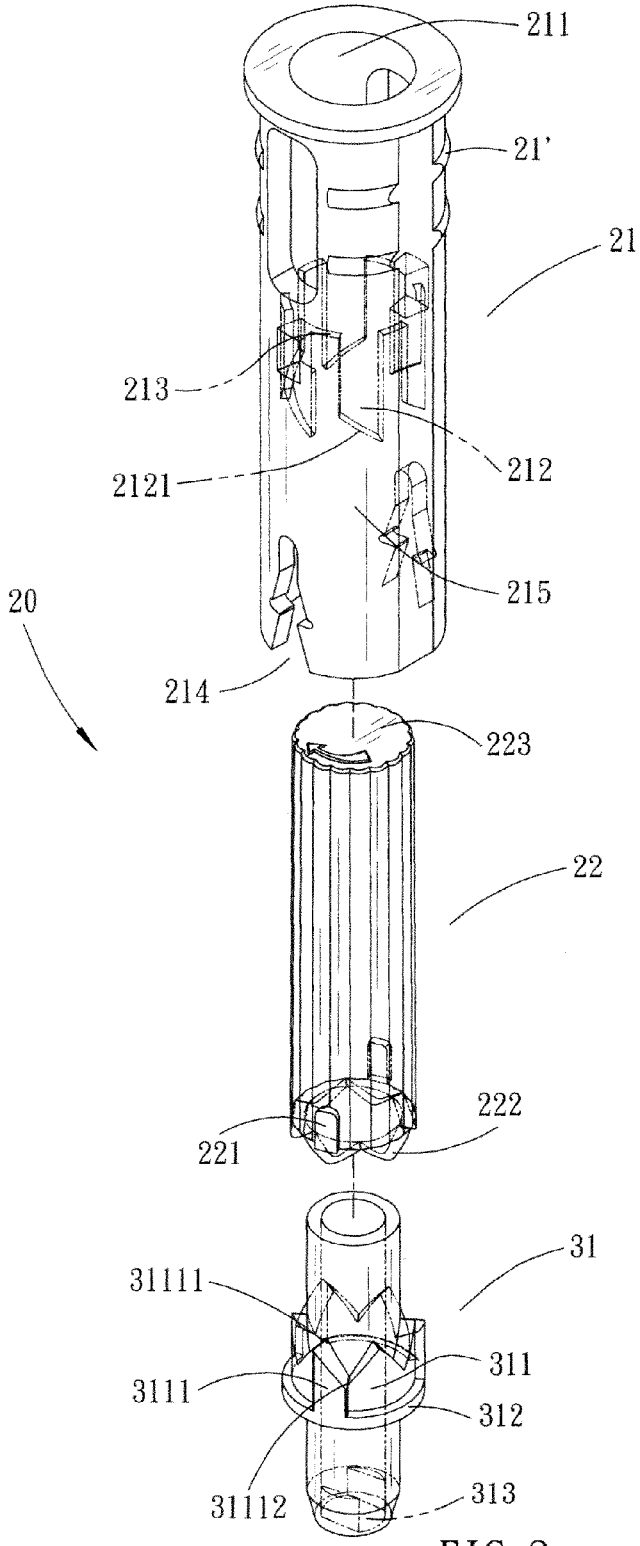
FIG. 2 is a partially exploded perspective view of the present invention.

Please refer to FIG. 1 showing an exploded perspective view of the present invention. The present invention relates to a cosmetics container structure, comprising an outer tube 10, a control assembly 20, an actuation assembly 30, a push rod 40, and an applying assembly 50. The outer tube 10 is composed of an actuating chamber 11 disposed at the upper section therein, a smaller-diameter stop edge 12 protruding at an appropriate position thereon, and a receiving chamber 13 extending downwards at the lower section therein. The outer tube 10 also has both internal end side surfaces respectively defined by multiple ringed depressions 14 thereon, and the external circumference of the lower end thereof equipped with multiple protrusive rings 15 to which multiple indented rings 16 defining the internal surface of a cap body 17 are interlocked therewith respectively. The control assembly 20 (referring to FIG. 2) is composed of a coupling cylinder 21, and a button post 22. The coupling cylinder 21 has one end equipped with multiple coupling rings 21' protruding at the external circumference thereon, a button opening 211 extending through the center therein, and multiple obliquely-cut pieces 212 alternating with clearance grooves 213 that are annularly spaced out at the internal surface thereon wherein each obliquely-cut piece 212 has one side obliquely-cut into a sliding surface 2121. The coupling cylinder 21 also has multiple notch-like insert grooves 214 cut at the opening edge of the other end thereon, and a rotary space 215 revealed between the insert grooves 214 and the obliquely-cut pieces 212 thereof. The button post 22 has an opening end defined by a serrated-like first toothed-collar 222 and a set of protrusive blocks 221 symmetrically disposed at the circumference above the first toothed-collar 222 thereof, and the other end equipped with an enclosure side 223 thereon. The actuation assembly 30 is made up of a rotary tube 31, a spring element 32, and an insert seat 33. The rotary tube 31 has the middle section of the external circumference equipped with a second toothed-collar 311 identically shaped like the first toothed-collar 222 thereof and having multiple toothed sections 3111 each composed of high and low stop surfaces 31111, 31112 thereon. Beneath the second toothed-collar 311 has a restrictive flange 312 extending thereon, and the lower opening end of the rotary tube 31 is disposed a conjoining cavity 313 having symmetrical flat surfaces straightly cut at both internal sides thereon. The insert seat 33 has a screw-threaded bore 331 disposed at the bottom thereon, and multiple insert blocks 332 protruding at the outer circumference thereon to interlock to the insert grooves 214 of the coupling cylinder 21 respectively. The push rod 40 includes a rod body 41 defined by an external threaded section 42 having both lateral sides symmetrically cut into flat surfaces identical to the configuration of the conjoining cavity 313 thereof. The push rod 40 also has the lower section equipped with a larger-diameter support surface 43 and a smaller-diameter coupling end 44 whose outer circumference has multiple coupling rings 441 extending thereon to fit to coupling recesses 451 defining the internal surface of a resilient stop plug 45 so as to connect the rod body 41 to the stop seat 45 thereby. The stop plug 45 has an abutment surface 452 disposed at the interior therein to which the coupling end 44 thereof is mounted to abut thereto. The stop plug 45 also has multiple annular grooves 453 defining the external circumference thereon for the accommodation of a sealing hoop 454 thereto. The applying assembly 50 is made up of a filling-guiding unit 51, an applying unit 52 and a covering sheath 53. The filling-guiding unit 51 has multiple depressions 511 defining the external circumference, a smaller-diameter transport tube 512 extending at the bottom, and a grooved portion 513 concaved at the top thereon to connect to the transport tube 512 thereby. The applying unit 52 can have brittles or a brush body mounted thereto and a duct 521 extending therein for the accommodation of the transport tube 512 thereto. The covering sheath 53 has the internal surface of one end equipped with protrusive ribs 531 and a coupling ring 532 protruding at the external surface thereon, permitting the depressions 511 of the filling-guiding unit 51 to precisely engage with the protrusive ribs 531 of the covering sheath 53 thereby.

Figure 3:
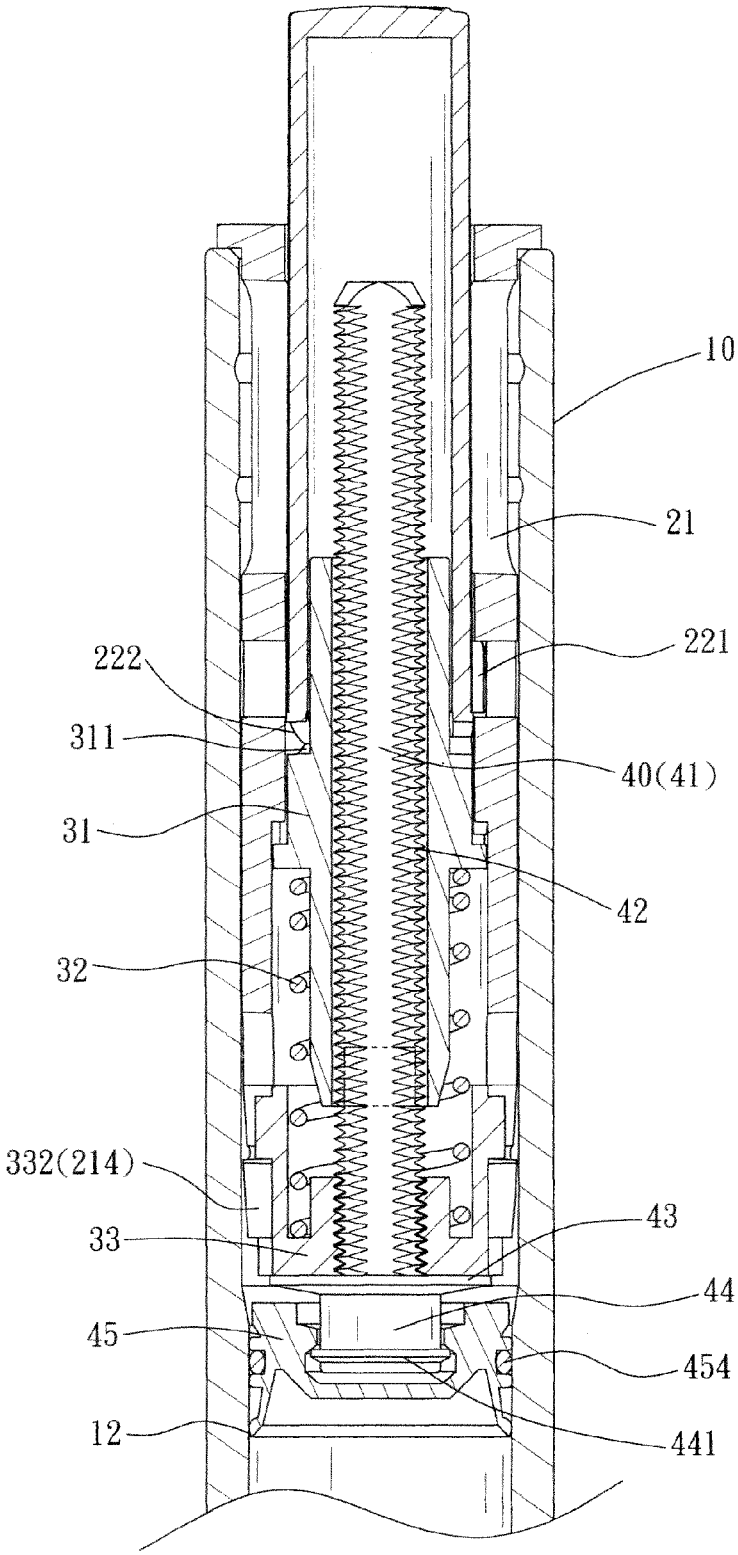
FIG. 3 is a partially assembled cross sectional view of the present invention.
Figure 4:
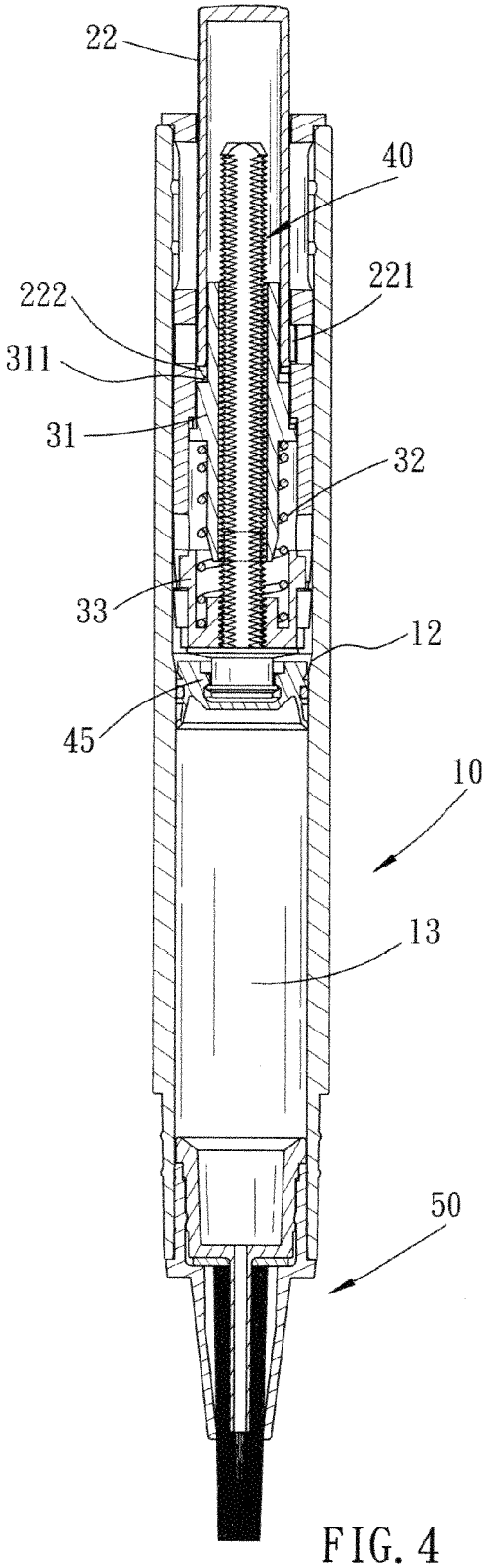
FIG. 4 is an assembled cross sectional view of the present invention.
Figure 5:
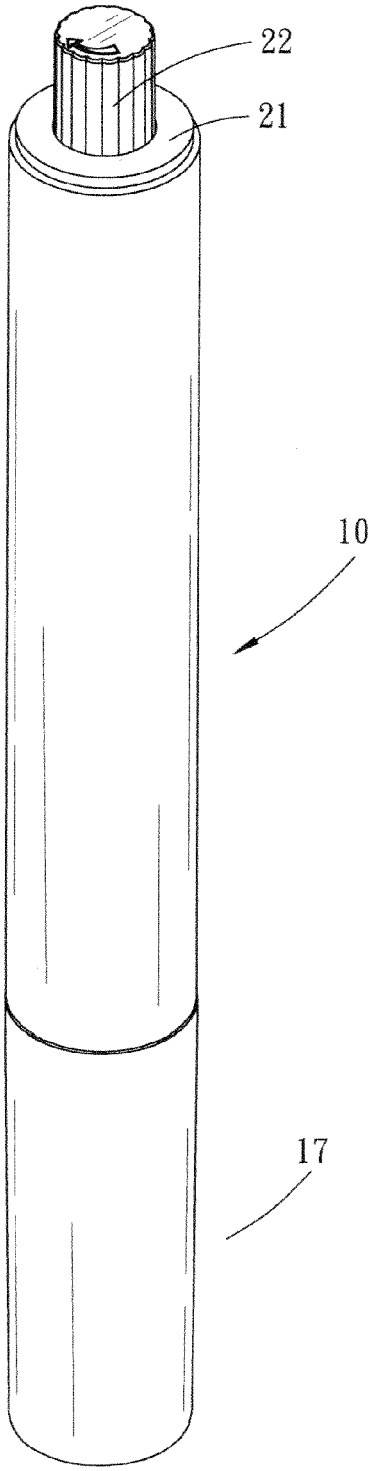
FIG. 5 is an assembled perspective view of the present invention.

In assembly (referring to FIGS. 3, 4, 5), the button post 22 of the control assembly 20 is guided from bottom to top so as to mount into the button opening 211 of the coupling cylinder 21 till the protrusive blocks 221 embedded into the clearance grooves 213 respectively, permitting the enclosure side 223 thereof to protrude outwards above the button opening 211 thereby. Then, the rotary tube 31 and the spring element 32 are assembled to each other before mounted into the coupling cylinder 21, and the push rod 40 engaged with the stop plug 45 is threaded along the screw-threaded bore 331 of the insert seat 33 till the insert seat 33 abutting against the support surface 43 thereby. Meanwhile, the push rod 40 is sequentially guided along the spring element 32 and the conjoining cavity 313 of the rotary tube 31 to mount into the button post 22 therein till the insert blocks 332 of the insert seat 33 firmly interlocked with the insert grooves 214 of the coupling cylinder 21. Thus, the control assembly 20, the actuation assembly 30, and the push rod 10 can be integrally assembled into one unit before accommodated into the actuating chamber 11 of the outer tube 10, permitting the sealing hoop 454 and the annular grooves 453 of the stop plug 45 to seal tight against the internal surface of the actuating chamber 11 so as to reinforce anti-leakage effect thereby. Then, the ringed depressions 14 disposed at one end of the outer tube 10 are allowed to firmly lock to the coupling rings 21' in a secure shutoff state. Therefore, filling substance put in from the other end of the outer tube 10 can be accommodated into the receiving chamber 13 and blocked by the sealing hoop 454 without the risk of infiltration into the actuating chamber 11 thereof. Finally, the applying assembly 50 is conjoined to the cap body 17, permitting the indented rings 16 of the cap body 17 to fit to the protrusive rings 15 of the outer tube 10 respectively, completing the assembly thereby.

Figure 6:
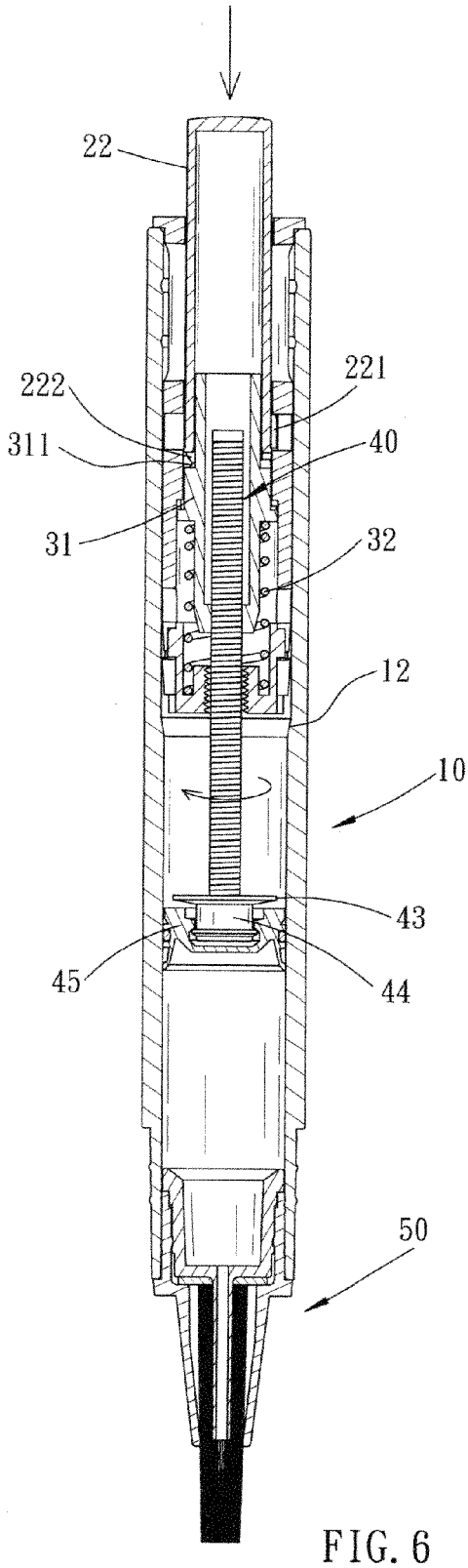
FIG. 6 is a diagram showing the operation of a button post pressed to actuate the rotation of a push rod of the present invention
Figure 7:
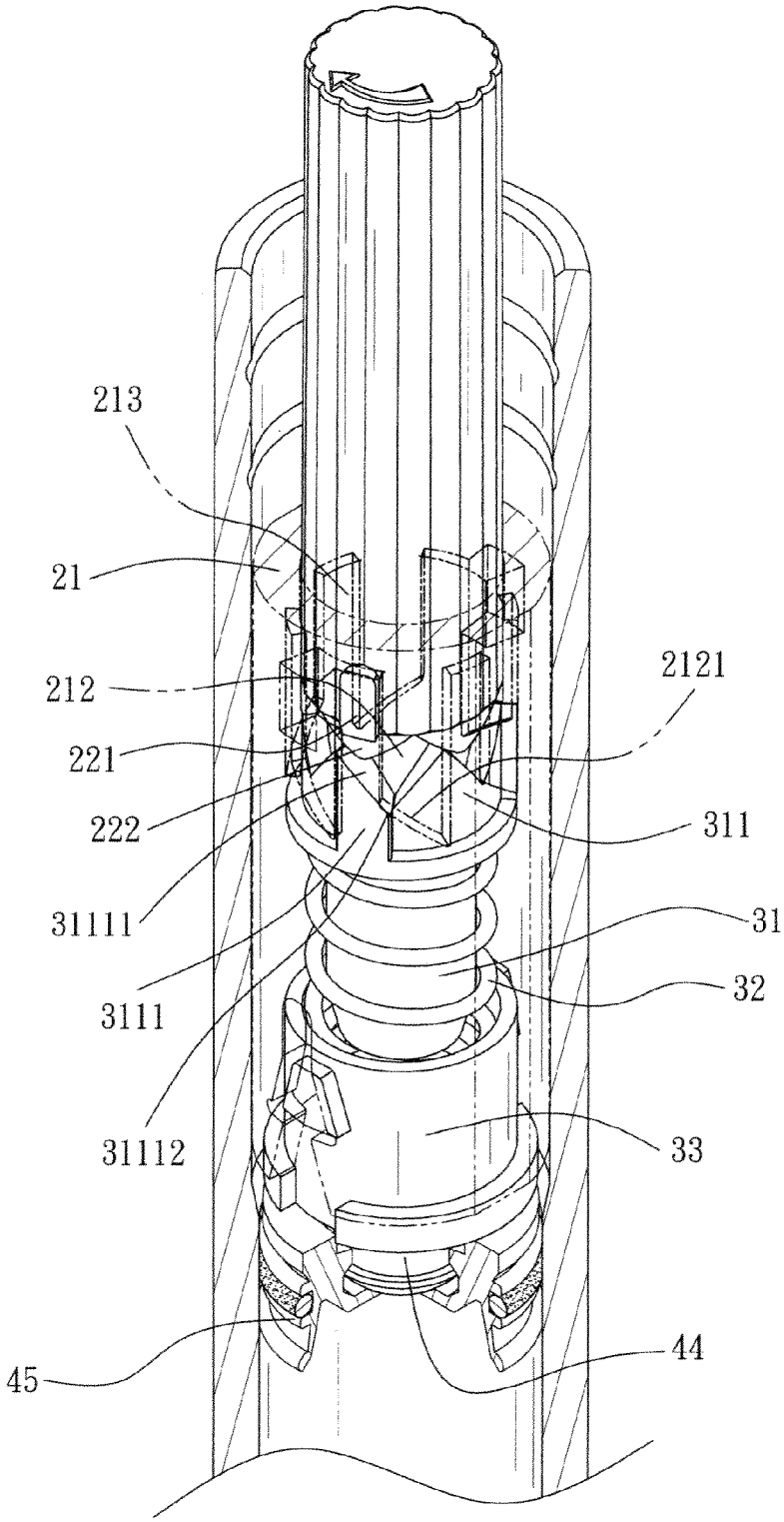
FIG. 7 is a diagram showing a first toothed collar and toothed sections of a second toothed-collars abutting against obliquely-cut pieces of the present invention.
Figure 8:
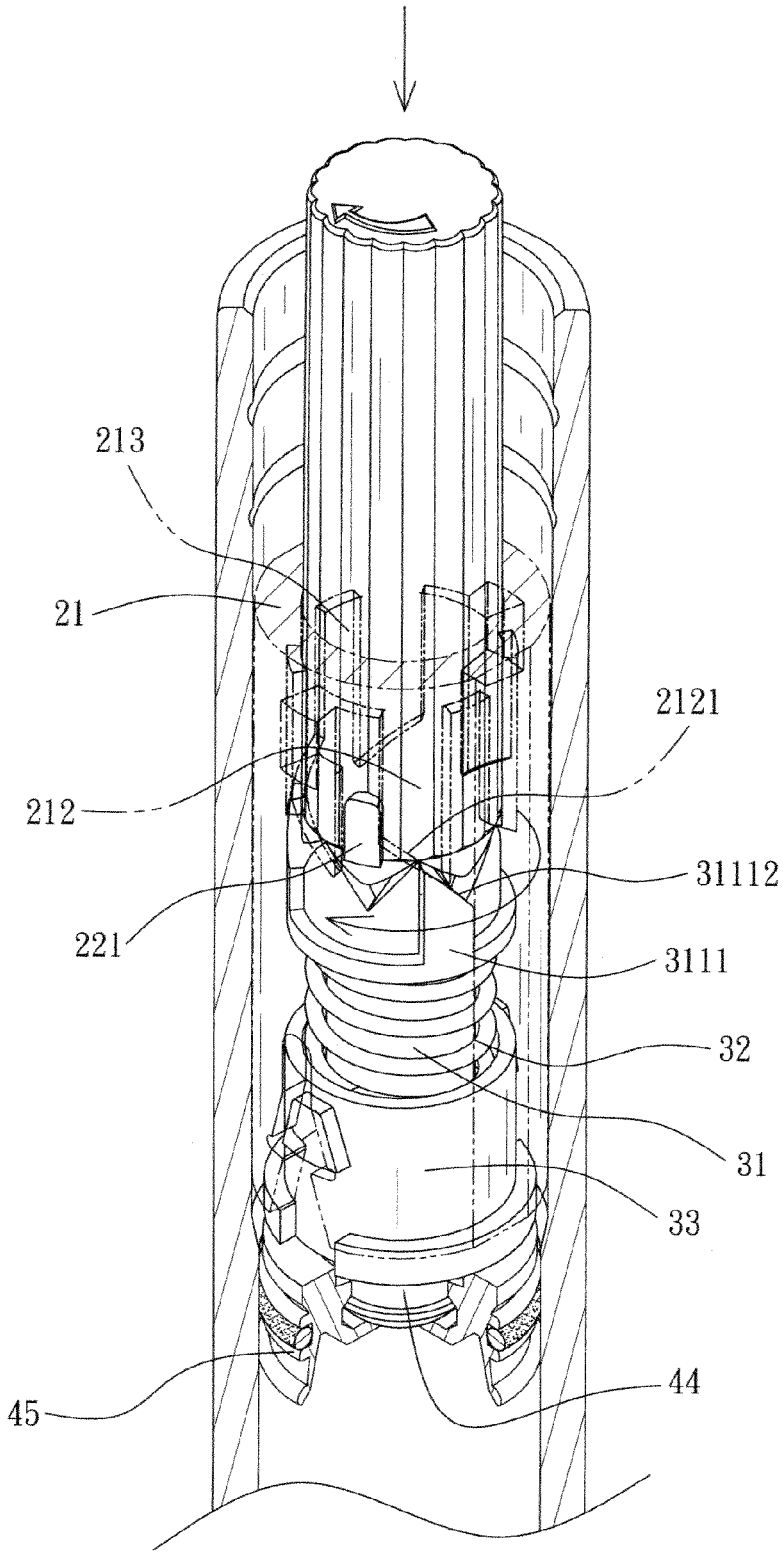
FIG. 8 is a diagram showing the rotation of a rotary tube of the present invention in pressing operation thereof.

In application (referring to FIGS. 6, 7), the button post 22 is simply pressed downwards, permitting the toothed sections 3111 of the second toothed-collar 311 to detach from the sliding surfaces 2121 of the obliquely-cut pieces 212 thereby. Then the first toothed-collar 222 is allowed to slide along the toothed sections 3111 of the second toothed collar 311, descending from the high stop surfaces 31111 to the low stop surfaces 31112 and moving for an appropriate distance as shown in FIG. 8. Meanwhile, the external-threaded section 42 of the push rod 40 actuated along with the spin of the rotary tube 31 will unscrew linearly downwards along the conjoining cavity 313 and the screw-threaded bore 331 to press against the stop plug 45 descending downwards for an appropriate length therewith. And the filling substance accommodated inside the receiving chamber 13 and squeezed by the descending stop plug 45 will be carried outwards via the transport tube 512 of the filling-guiding unit 51 and released to the applying unit 52 for application thereby. Finally, the spring element 32 will rebound backwards, synchronically actuating the toothed sections 3111 thereof to bounce upwards along the sliding surfaces 2121 therewith. Thus, the outer tube 10 can be simply held by single hand and directly applied for putting on cosmetics, efficiently improving the disadvantages of the above-mentioned double-hand-held rotary cosmetics containers. Besides, the portion of the filling material released can be accurately determined by the number of pressing operation without any waste of it, achieving easy and economical application thereby.

What is claimed is:

1. A cosmetics container structure, comprising an outer tube, a control assembly, an actuation assembly, a push rod, and an applying assembly wherein the outer tube is composed of an actuating chamber at one end side and a receiving chamber at the other end side to which the applying assembly is mounted at the bottom before a cap body is snapped on thereto;

the control assembly being made up of a coupling cylinder and a button post wherein the coupling cylinder, accommodated into the actuating chamber of the outer tube, has a button opening extending through the center therein, and multiple obliquely-cut pieces alternating with clearance grooves that are annularly spaced out at the internal surface thereon; and, each obliquely-cut piece has one side obliquely-cut into a sliding surface; the button post, accommodated into the coupling cylinder, has an opening end equipped with a serrated-like first toothed-collar and a set of protrusive blocks symmetrically disposed at the circumference above the first toothed-collar thereof;

the actuation assembly being composed of a rotary tube, a spring element, and an insert seat wherein the rotary tube has the external circumference equipped with a second toothed-collar identically shaped like the first toothed-collar of the button post and forming multiple toothed sections each composed of high and low stop surfaces thereon; the rotary tube also has a conjoining cavity defining the internal surface of the lower opening end thereon; the insert seat, mounted into the internal lower end of the coupling cylinder, has a screw-threaded bore disposed at the bottom thereon;

the push rod has a rod body defined by an external threaded section identically shaped like the conjoining cavity of the rotary tube to be mounted into the rotary tube and linked in actuation therewith; the push rod also has the lower end fixed to a resilient stop plug equipped with a sealing hoop thereon;

therefore, via the aforementioned structure, the button post can be easily pressed by single hand to squeeze out filling substance accommodated inside the receiving chamber of the outer tube, and the portion of the filling substance released can be accurately determined by the number of pressing operation without any waste of it, achieving easy and economical application thereby.

2. The cosmetics container structure as claimed in claim 1 wherein the outer tube has a smaller-diameter stop edge protruding at an appropriate position of the internal surface thereon.

3. The cosmetics container structure as claimed in claim 1 wherein the outer tube has the external circumference of the lower end thereof equipped with multiple protrusive rings to which multiple indented rings defining the internal surface of the cap body are conjoined therewith respectively.

4. The cosmetics container structure as claimed in claim 1 wherein the coupling cylinder also has multiple notch-like insert grooves cut at the edge of one opening end thereon, to which the insert blocks protruding at the external circumference of the insert seat is fitted and locked thereto respectively.

5. The cosmetics container structure as claimed in claim 1 wherein the button post can have one end equipped with an enclosure side.

6. The cosmetics container structure as claimed in claim 1 wherein the rotary tube can have a restrictive flange extending beneath the second toothed-collar thereof.

7. The cosmetics container structure as claimed in claim 1 wherein the conjoining cavity of the rotary tube and the rod body of the push rod can have both lateral sides identically shaped into a flat-surfaced configuration respectively.

8. The cosmetics container structure as claimed in claim 1 wherein the push rod has the lower section equipped with a larger-diameter support surface and a smaller-diameter coupling end whose outer circumference has multiple coupling rings extending thereon to fit to coupling recesses defining the internal surface of the resilient stop plug so as to fix the rod body to the stop plug thereby; the stop plug also has an abutment surface disposed at the interior therein to which the coupling end thereof is mounted to abut thereto; besides, the stop plug also has multiple annular grooves defining the external circumference thereon for the accommodation of a sealing hoop thereto.

9. The cosmetics container structure as claimed in claim 1 wherein the applying assembly is made up of a filling-guiding unit, an applying unit and a covering sheath; the filling-guiding unit has multiple depressions defining the external circumference thereon, a smaller-diameter transport tube extending at the bottom, and a grooved portion concaved at the top thereon to connect to the transport tube thereby; the applying unit can have brittles or a brush body mounted thereto and a duct extending therein for the accommodation of the transport tube thereto; the covering sheath has the internal surface of one end equipped with protrusive ribs and a coupling ring protruding at the bottom thereon, permitting the depressions of the filling-guiding unit to precisely engage with the protrusive ribs of the covering sheath thereby.

10. The cosmetics container structure as claimed in claim 1 wherein the outer tube has the internal surface of one end defined by multiple ringed depressions to which the coupling rings protruding at the external circumference of one end of the coupling cylinder are fitted and interlocked therewith respectively.

* * * * *